US005647075A

United States Patent [19]

Perkins

[11] Patent Number: 5,647,075

[45] Date of Patent: Jul. 15, 1997

[54] TABLE FOR HAMMOCK STAND

[75] Inventor: Julian Perkins, Greenville, N.C.

[73] Assignee: Hatteras Hammocks, Inc., Greenville, N.C.

[21] Appl. No.: 606,207

[22] Filed: Feb. 23, 1996

[51] Int. Cl.[6] ..... A45F 3/24

[52] U.S. Cl. ..... 5/127; 5/507.1; 108/26; 108/49

[58] Field of Search ..... 5/127, 128, 129, 5/130, 507.1; 108/25, 26, 49

[56] References Cited

U.S. PATENT DOCUMENTS

| | | | |
|---|---|---|---|
| 1,588,914 | 6/1926 | Smith | 108/49 X |
| 1,862,237 | 6/1932 | Pepler | 108/49 |
| 1,957,165 | 5/1934 | Gingras | 108/49 |
| 2,563,156 | 8/1951 | Carl | 5/129 X |
| 2,571,037 | 10/1951 | Hoffman | 5/128 |
| 3,875,873 | 4/1975 | Howitt | 108/25 |

*Primary Examiner*—Michael F. Trettel
*Attorney, Agent, or Firm*—Gipple & Hale

[57] ABSTRACT

A table for use with a hammock stand or similar structure is described. The device attaches removably to the base of the stand and is adjustable in height and orientation to facilitate moving the table so as not to interfere with access to or use of the hammock.

3 Claims, 2 Drawing Sheets

TABLE FOR HAMMOCK STAND

FIELD OF THE INVENTION

The present invention is a table specifically designed for attachment to the base of a supposing structure such as a hammock stand or similar device. The table of the invention is constructed in such a way that it can be employed with virtually all hammock studs or other, similar structures such as a chair or lounge to which it can be attached. The unique construction of the table of the invention permits its to be rotated out of the way to facilitate access to the hammock or other structure.

BACKGROUND OF THE INVENTION

Hammocks and lodge chairs along with more conventional outdoor seating accommodations have become increasingly popular and frequently the focus of outdoor social events as well as providing opportunity for leisure and rest. In these circumstances, it is clearly desirable that provision be made to accommodate food, beverages, and other accouterments of pleasant outdoor relation which require a surface which is easily accessible.

Accordingly, it would be highly desirable if tables or trays could be provided in close proximity to the hammock or chair. Unfortunately, ordinary trays or detached tables while sufficient for holding food and beverages also tend to get in the way of the individual entering, exiting or swinging in the hammock. Further, such tables are not necessarily of the appropriate height for convenient use by individuals reclining in a hammock or lounge chair.

There is, therefore, a need for a table structure which does not require multiple legs that impede its placement near a hammock or lounge chair but which can be easily attached to the base of the hammock stud or chair in a way that permits ready access to the table surface when desired but which also permits the table to be easily reed out of the way so as not to impede either movement of the hammock or entry or exit therefrom.

It is further desirable to provide such a table structure that is adapted to essentially be attached to any hammock stand or similar structure.

DETAILED DESCRIPTION OF THE INVENTION

In accordance with the present invention, a table is provided for attachment to the base of a hammock stand or similar structure. The table of the present invention comprises a flat planar table top having a bottom surface which is pivotally attached to one end of an elongated downwardly extending vertical support member. The other end of the vertical support member is bent at approximately right angles to extend horizontally and parallel to the plane of the table top. The horizontal extension of the vertical support of the table of the invention is adapted to engage at its other end with the support structure of a hammock stand or similar device. Conveniently, the support member of the table of the invention is made of a tubular material such as steel, fiberglass, or plastic having sufficient rigidity to maintain the table top firmly in place even when food, beverages, or other accouterments are placed on it. The distal end of the horizontal extension of the support member conveniently engages a similar horizontal support member on the hammock stand base. This engagement can, for example, be by having one member slidably fit within the other. It will be apparent in this regard that it does not matter whether the horizontal extension of the table support assumes the male or female relationship in such engagement.

The device of the invention will, however, be more fully appreciated by having specific reference to the drawings which illustrate a preferred embodiment of the invention.

Figure 1:
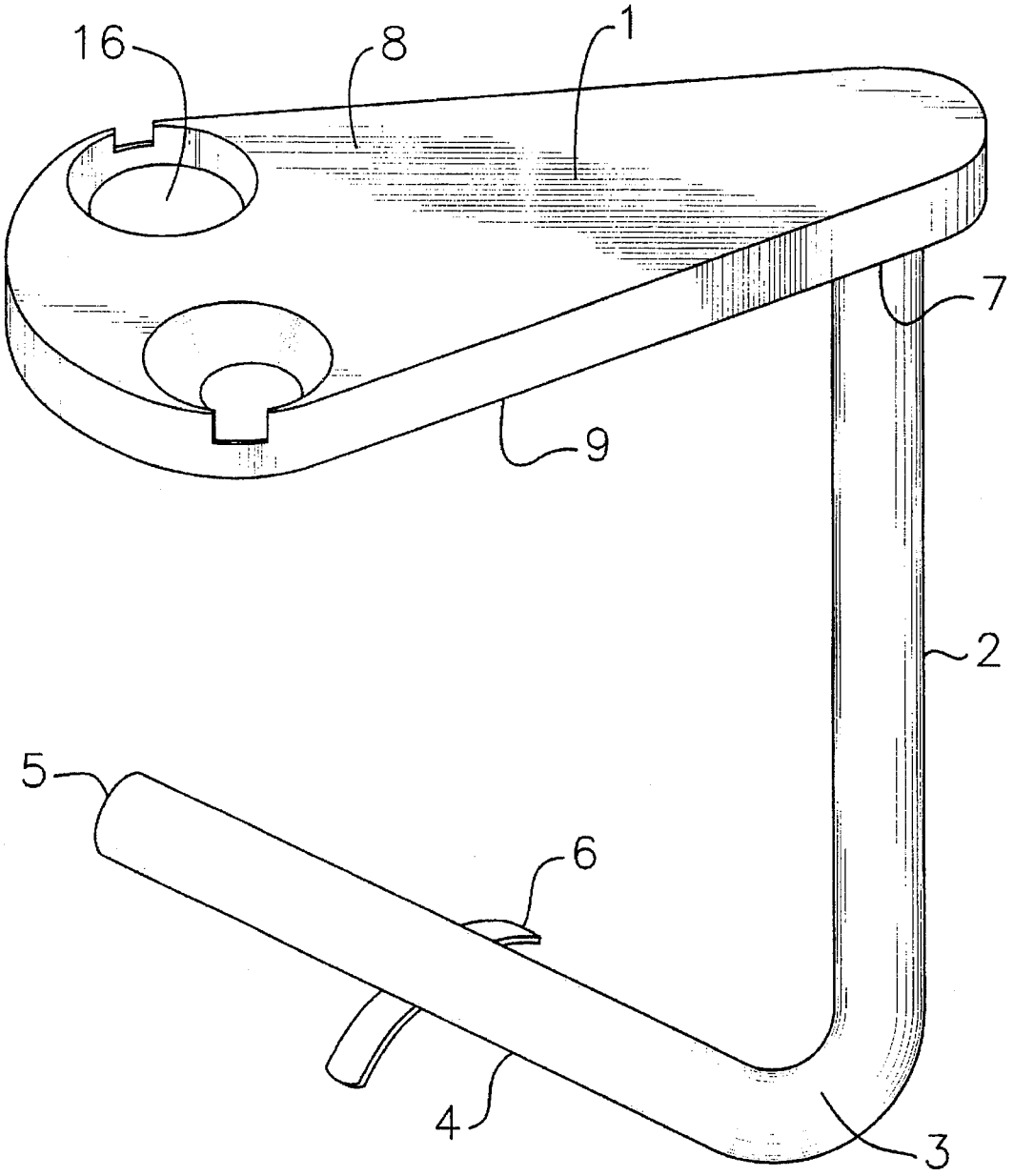
FIG. 1 is perspective view of the table and support structure of the present invention.

Directing attention initially to FIG. 1 of the drawings, which shows the table of the invention in its unattached configuration, table top 1 is shown having an oblong configuration although it will be understood that other configurations can equally well be employed such as circular or square. The table top 1 has a top surface 8 and a bottom surface 9 and is optionally provided with one or more holes or recesses 16 to accommodate such items as glasses, cups, or ash trays. Although not illustrated, it will be understood that the top surface of the table top can also be provided with a lip or indentations to accommodate specific accouterments. An elongated vertical support 2 engages the bottom surface 9 of the table top at 7. In this respect it will be noted that the point of engagement between the vertical support and the table top is significantly offset from the center of the table top in order to permit the table top to revolve about the longitudinal axis of the vertical support so that it can be turned out of the way to facilitate entry or exit from the hammock when it is not being used. The actual structure of the point of engagement 7 between the vertical support and the bottom surface of the table top has not been illustrated but will be understood to be preferably a pivoting support that permits the table top to be turned, as described above, in a horizontal plane. Such engagement can conveniently be a simple socket into which the end of the vertical support slips at 7. It will also be appreciated that in order to maintain sufficient rigidity in the table top, especially when food or beverage items are placed on it, engagement between the bottom surface of the table top and the vertical support should be sufficiently strong. This can be accomplished by having a socket attached to the bottom of the table top into which the vertical support fits, the socket being provided with a sufficiently wide horizontal flange to be attached firmly to the bottom of the table top or it may be further reinforced by ribs extending outward from the point of attachment 7 along the bottom surface 9 of the table top. It will also be appreciated that any socket or means of attachment provided at 7 should preferably be of sufficient length to permit vertical adjustment between the table top 1 and the vertical support 2 so that the height of the table can be varied depending upon the height or the hammock or structure to which it is attached. Such variable adjustment can for example be achieved by having an elongated socket attached to the bottom surface of the table top which permits extended sliding engagement with the vertical support. Alternatively, vertical support 2 can have an ajustable, telescoping configuration.

The lower end of vertical support 2 is bent at approximately right angles at 3 to form a horizontal extension 4. It will be understood that the location of the right angle turn in the vertical support is determined by the intended height or range of heights for the entire table structure. Horizontal extension 4 is provided at 6 with a foot to stabilize its engagement with the ground surface upon which it rests and prevent rotation of the table. The distal end of horizontal extension 4 at 5 is of appropriate cross section configuration to engage with the supporting base structure of a hammock stand or similar device.

Figure 2:
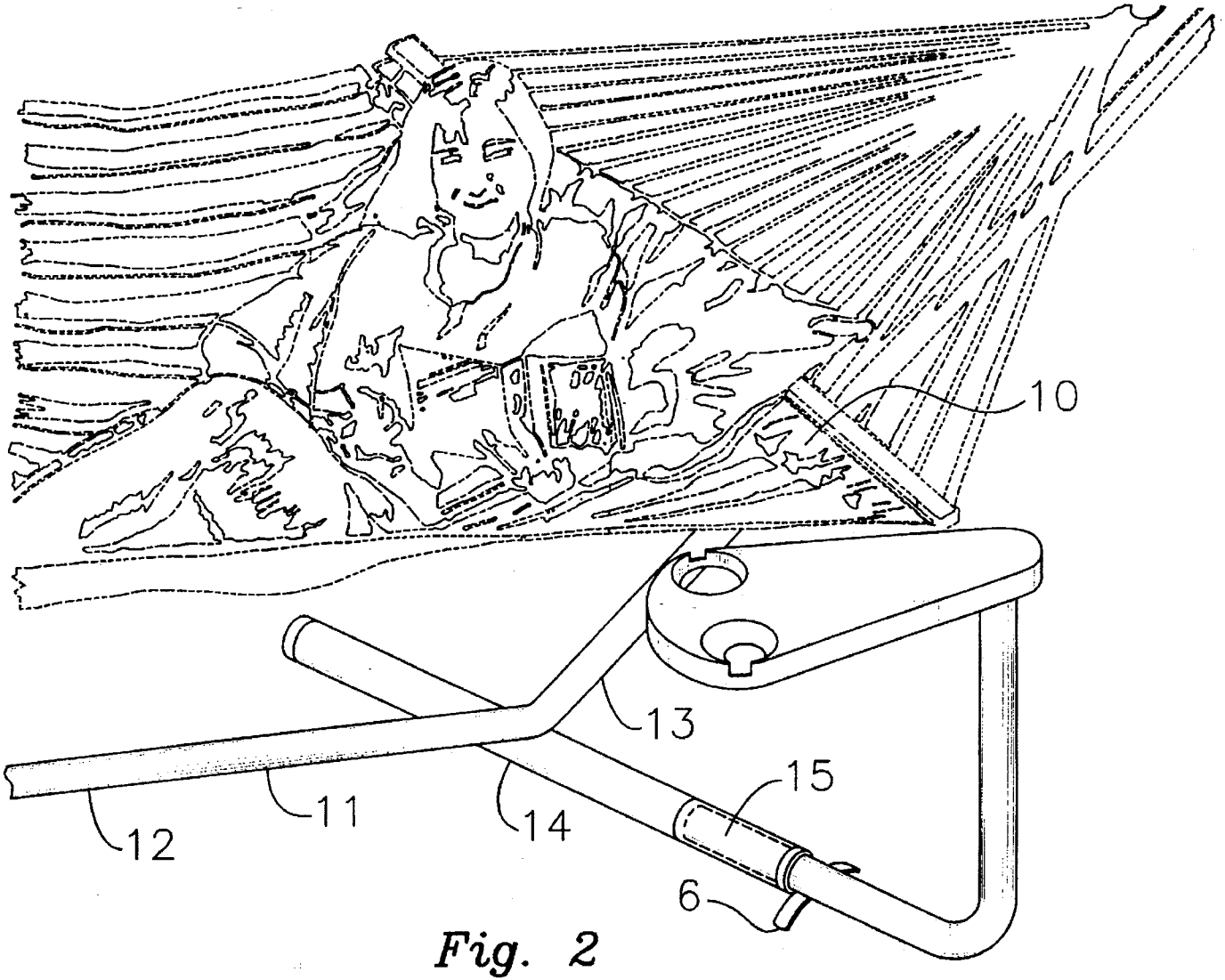
FIG. 2 illustrates the table and support structure of the present invention engaged with the base of a hammock stand.

Directing attention to FIG. 2 of the drawings the actual engagement between horizontal extension 4 and hammock stand 11 is illustrated. As shown in the drawings, a hammock stand constructed of tubular members is shown having a horizontal elongated base member 12 which terminates at each of its ends with a pair of upright standards 13 from whose upper distal ends hammock 10 is suspended. Stability of the hammock stand is maintained by a pair of elongated horizontal cross braces 14 which maintain the hammock and hammock stand 11 in proper upright orientation. As illustrated in the drawings, one end 15 of the horizontal cross brace 14 is of sufficient dimensions to permit the end 5 of horizontal extension 4 to be inserted within it to provide appropriate engagement with the table structure of the invention. The support member of the table is prevented from rotating by foot 6 which engages the ground surface. It will of course be understood that proper orientation of the support and table top could also be achieved by means of a pin or set screw passing through the tubular horizontal cross brace and the horizontal extension fitting inside it. Also it will be appreciated that while the drawing illustrates the horizontal cross brace having the female configuration and the horizontal extension 4 the male configuration, these roles could be reversed. It will also be understood that other means of attachment commonly known in the art could be as well employed to provide satisfactory engagement between the support structure of the table and the horizontal cross piece or base member of the hammock stand or other similar structure.

What is claimed is:

1. A combination table and hammock stand comprising a stand for suspending a hammock horizontally above the ground comprising an elongated, horizontal base member which terminates at each of its two ends in an upward extending elongated member adapted to receive at its upward extremity one end of a hammock, said horizontal base member having one or more horizonal elongated cross braces which engage it at right angles; a table attached to one of said cross braces comprising a flat planar table top having opposed top and bottom surfaces, said bottom surface having attached thereto at one of its ends an elongated, downwardly extending vertical support member which is bent at right angles to extend horizontally and parallel to said table top; said horizontal extension engaging at its distal end with one of said cross braces.

2. The combination table and hammock stand of claim 1 wherein said horizontal extension has a tubular cross section which slidably engages with said horizontal base member.

3. The combination table and hammock stand of claim 1 wherein said bottom surface of the table top is pivotally attached to said vertical support member to permit rotation of said top about the longitudinal axis of said vertical support member.

* * * * *